US009809043B2

(12) United States Patent
Tauber

(10) Patent No.: US 9,809,043 B2
(45) Date of Patent: Nov. 7, 2017

(54) ADVENT CALENDAR

(71) Applicant: MARS, INCORPORATED, McLean, VA (US)

(72) Inventor: Marcell Tauber, Verden (DE)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 15/037,260

(22) PCT Filed: Nov. 12, 2014

(86) PCT No.: PCT/EP2014/074346

§ 371 (c)(1),
(2) Date: May 17, 2016

(87) PCT Pub. No.: WO2015/071293

PCT Pub. Date: May 21, 2015

(65) Prior Publication Data

US 2016/0288560 A1 Oct. 6, 2016

(30) Foreign Application Priority Data

Nov. 18, 2013 (DE) ..... 10 2013 019 178

(51) Int. Cl.
*A47F 5/00* (2006.01)
*B42D 5/04* (2006.01)
(Continued)

(52) U.S. Cl.
CPC ..... *B42D 5/047* (2013.01); *A47F 5/00* (2013.01); *A47G 33/00* (2013.01); *B42D 5/046* (2013.01); *G09D 3/00* (2013.01)

(58) Field of Classification Search
CPC . G09F 1/10; A47F 7/143; B42F 17/00; A47G 33/06
See application file for complete search history.

(56) References Cited

U.S. PATENT DOCUMENTS 2,587,003 A * 2/1952 Shina ..... A47G 33/06 206/457
2,916,843 A * 12/1959 Meyer ..... A47G 33/06 40/124.4

(Continued)

FOREIGN PATENT DOCUMENTS

CN 201064368 5/2008
DE 8808100 8/1988

*Primary Examiner* — Cassandra Davis
(74) *Attorney, Agent, or Firm* — Mars, Incorporated

(57) ABSTRACT

The present invention relates to an advent calendar (1) comprising: a central axis (10), from which at least three side parts (2) extend substantially radially outwards, wherein i) the side parts are joined together, preferably in the region of the central axis, ii) at least one side part is removable or can be swung or folded over onto an adjacent side part and can preferably be attached to the adjacent side part, iii) there are distributed over the side parts at least 24 pre-punched recess fields (3), which can be removed from the side parts and, after removal, each provide recesses (4) in the side parts, each of which has a first suspension device (5), for example a hook (6, 7) for hanging an article in the recess and/or wherein there are distributed on fields of the side parts at least 24 pre-punched second suspension devices, which can preferably be folded or bent out of the fields.

14 Claims, 4 Drawing Sheets

(51) Int. Cl.
*A47G 33/00* (2006.01)
*G09D 3/00* (2006.01)

(56) References Cited

U.S. PATENT DOCUMENTS 2,988,837 A * 6/1961 Hutton ..... A47G 33/06
156/61
3,027,671 A * 4/1962 Duvall ..... A47G 33/06
248/225.11
3,655,495 A * 4/1972 Carrell ..... F21S 4/10
362/121
4,993,560 A * 2/1991 Jaffe ..... A47G 1/065
211/113
D354,928 S * 1/1995 Hoffman ..... D11/118
5,603,175 A 2/1997 Brenner
5,670,219 A * 9/1997 Na ..... A47G 33/08
428/133
5,911,328 A 6/1999 Shampo
D424,329 S * 5/2000 Lundberg ..... D6/674
D468,131 S * 1/2003 Weichert ..... D6/679

* cited by examiner

ADVENT CALENDAR

The present invention relates to an advent calendar.

Advent calendars are seasonal products which are used from 1st to 24th December and usually contain 24 small wrapped presents, one of which is can be taken out of the advent calendar each day and unwrapped in order to count down the days to Christmas Eve.

Ready-made advent calendars filled with a wide variety of articles, such as chocolate, are commercially available. Home-made advent calendars, however, are usually much more individual and express greater affection if an advent calendar of this kind is given to someone as a present.

Not only do the contents of an individually designed advent calendar express greater affection, but constructing and filling the advent calendar already contributes to a Christmas mood at an early stage. That is comparable to putting up the right Christmas tree shortly before 24th December, so that the user becomes involved on an emotionally very similar level. The user can thus not only set up the advent calendar himself, but can also fill it with a very wide range of products/varieties, e.g. special items on 6th December (feast of St. Nicholas) and 24th December (Christmas Eve).

A frequent disadvantage of home-made advent calendars is that this kind of advent calendar cannot be used very variably—for example it can only be used as a standing advent calendar or only hung on a wall or from the ceiling. Attaching the small presents to the advent calendar is often problematic if different hanging and mounting mechanisms for the advent calendar have to be taken into account.

It is therefore an object of the present invention to provide an advent calendar which overcomes the disadvantages from the state of the art and in particular enables a more flexible variation in mounting and easy attachment of different presents to the advent calendar. In addition, the advent calendar of the invention should be easy to assemble and dismantle, while being suitable for storage for the rest of the year as compactly as possible, and it should be simple for the end user to transport. In addition, it is particularly preferable for it to be possible to dispose of the advent calendar of the invention with no difficulty.

This problem is solved by an advent calendar comprising:

a central axis, from which at least three side parts extend substantially radially outwards, wherein i) the side parts are joined together, preferably in the region of the central axis, ii) at least one side part is removable or can be swung or folded over onto an adjacent side part and can preferably be attached to the adjacent side part iii) there are distributed over the side parts at least 24 pre-punched recess fields, which can be removed from the side parts and, after removal, each provide recesses in the side parts, each of which has a first suspension device for hanging an article in the recess and/or wherein there are distributed on fields of the side parts at least 24 pre-punched second suspension devices, which can preferably be folded or bent out of the fields.

Most preferably, the pre-punched recess fields and/or the pre-punched second suspension devices are distributed over all side parts of the advent calendar, wherein the recess fields are pre-perforated regions which can be removed or pressed out from the side parts.

The advent calendar is preferably made of cardboard. If the advent calendar of the invention is made solely of cardboard, no additional components made from other materials are required to fix the presents to the advent calendar. Making the calendar from a single material facilitates disposal.

It is likewise preferable that angles between adjacent side parts extending radially outwards should be substantially identical. Hence, if a total of three side parts are used, they each form an angle of about 120° to each other. If, on the other hand, a total of four side parts are used, they should form an angle of about 90° between adjacent side parts.

It is particularly preferable that it should be possible to plug the side parts into one another in a releasable manner, preferably in the region of the central axis, preferably with a tongue-and-groove system, hook system, hinge mechanism or some other plug-in system.

It is most preferable that the advent calendar should have four side parts.

It is preferably contemplated that the first suspension devices should be formed like hooks in the recesses.

It is preferable that the advent calendar should comprise a fixing means for attaching the advent calendar to a wall or ceiling, preferably in an upper region of at least one side part, preferably in the form of an eyelet.

The recesses are preferably numbered on the side parts with the numbers from 1 to 24.

Finally, it is preferable that it should be possible to fold at least one side part over onto an adjacent side part via a hinge mechanism. The person skilled in the art is aware of other mechanisms for folding one side part over onto an adjacent side part. It is, for example, conceivable to have a perforation applied to a side part, via which the side part can be removed, though that side part can be joined on again via a hook-in system or the like, in order to preserve flexibility.

It has surprisingly been found that the advent calendar of the invention exhibits great variability, so that it can, for example, be used as a three-dimensional standing advent calendar or can be attached to a wall or ceiling.

The advent calendar of the invention can be assembled and filled with presents in a simple manner, with a great variation of possibilities existing for the way it is set up and filled with presents.

Furthermore, since the advent calendar of the invention preferably consists of one material, such as cardboard, it is simple to dispose of, because, once the presents have been removed, there is no mixture of materials left which would make it difficult to separate and dispose of the individual materials.

The size and shape of the recesses in the side parts of the advent calendar of the invention can be defined as required. Especially if presents to be hung on the advent calendar are to be sold together with the advent calendar, it is possible to adapt the size and shape of the recesses accordingly in advance.

Further advantages and features of the advent calendar of the invention will become clear from the following detailed description of preferred embodiments with reference to the attached drawing, in which FIG. 1 shows a schematic illustration of an embodiment of an advent calendar of the invention with four side parts, recess fields and first suspension devices;

Figure 1:
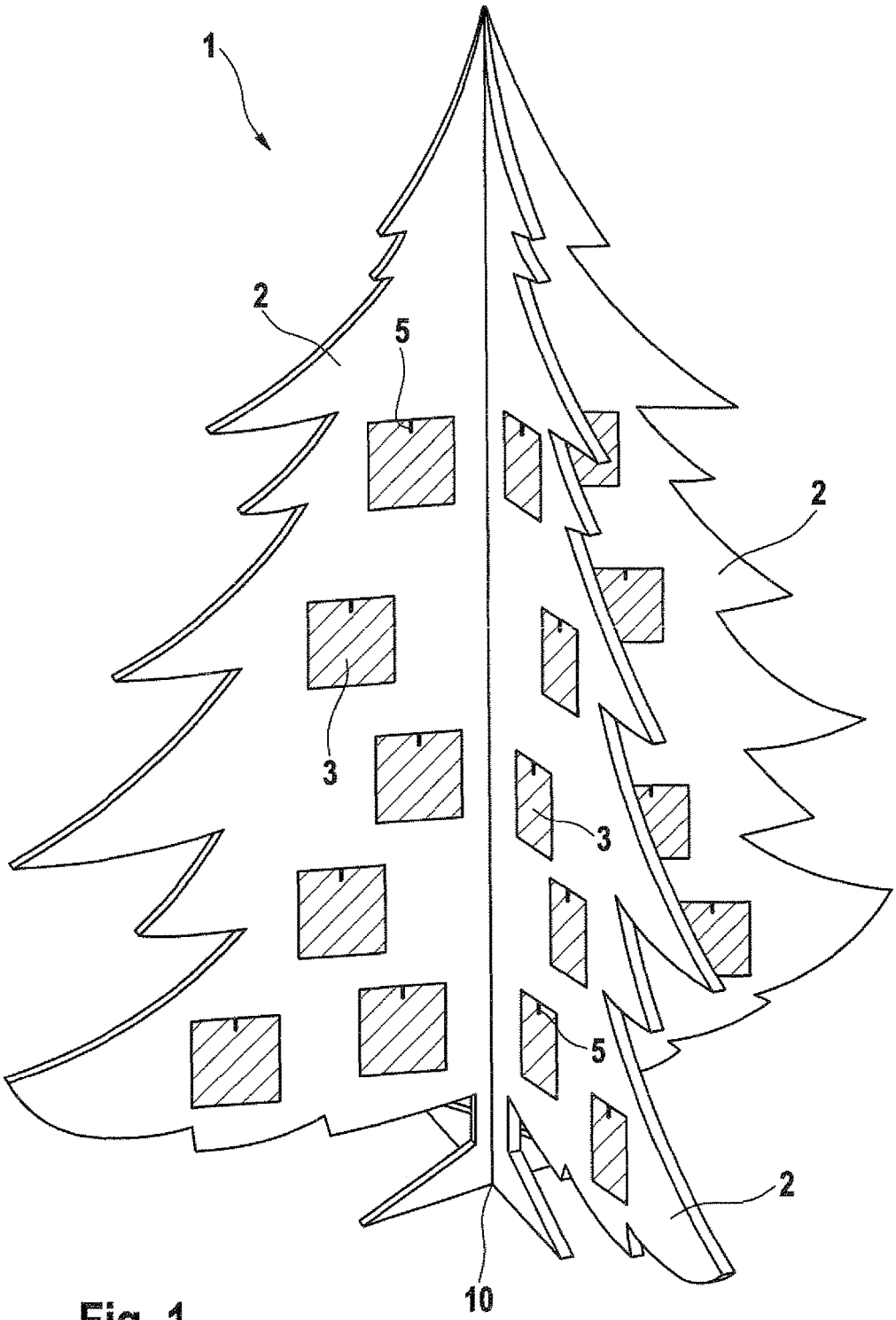

FIG. 1 shows an advent calendar 1 of the invention in the form of a christmas tree. The advent calendar 1 comprises four side parts 2, three of which can be seen in FIG. 1, while the fourth side part 2 is largely concealed. The side parts 2 extend radially outwards from a central axis. The side parts 2 can be joined together by means known to persons skilled in the art. For example, the individual side parts 2 can be joined together by a tongue-and-groove system, though it is also conceivable, for example, to glue the side parts together, especially if the individual parts are not intended to be separable from one another after assembly.

Each side part 2 has six pre-punched recess fields 3, which the user can easily press out of the side parts 2 or remove in some other way when assembling the advent calendar 1. After the pre-punched recess fields 3 have been removed from the side parts 2, there remains within a recess 4 formed (cf. FIGS. 2 and 3) a first suspension device 5 for receiving an item (present, not shown) in the recess 4.

The recesses 4 shown in FIG. 1 are substantially square. It is, however, obvious that any other shape of the recesses 4 which is suitable for hanging up items/presents can be provided as long as a first suspension device is provided within the recess 4.

Figure 2:
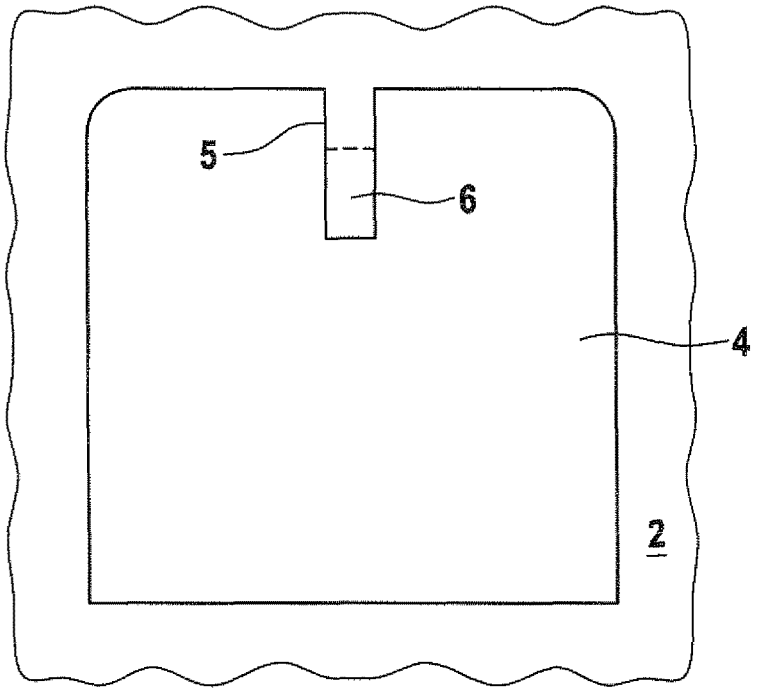
FIG. 2 shows a schematic illustration of a recess with a first suspension device.

A first suspension device 5 is shown in an enlarged view in FIG. 2. In FIG. 2, in the upper region of the recess 4, the first suspension device 5 in the form of a hook is illustrated, the lower part 6 of which can folded over substantially upwards at the dashed line in order to provide a hook.

Figure 3:
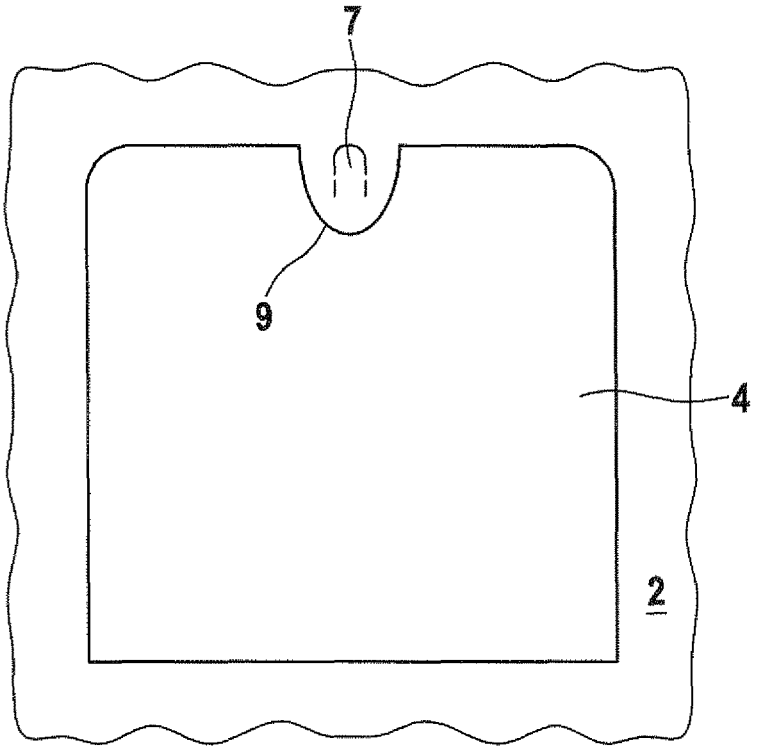
FIG. 3 shows a schematic illustration of a recess with a further alternative first suspension device.

In a further embodiment of this first suspension device, it is conceivable that a lip 9 projects into the upper region of the recess 4. A hook 7 which can be bent or folded out may be provided on that lip, so that packages, such as pet food packages, can be hung on it. An embodiment of this kind is shown in FIG. 3.

In this way, when the pre-punched recess fields 3 are taken out, items/presents can be hung in the respective recesses using the first suspension device. The pre-punched recess fields 3 can be removed in the case of the advent calendar 1 of the invention especially if the advent calendar is to be used as a standing advent calendar.

Figure 4:
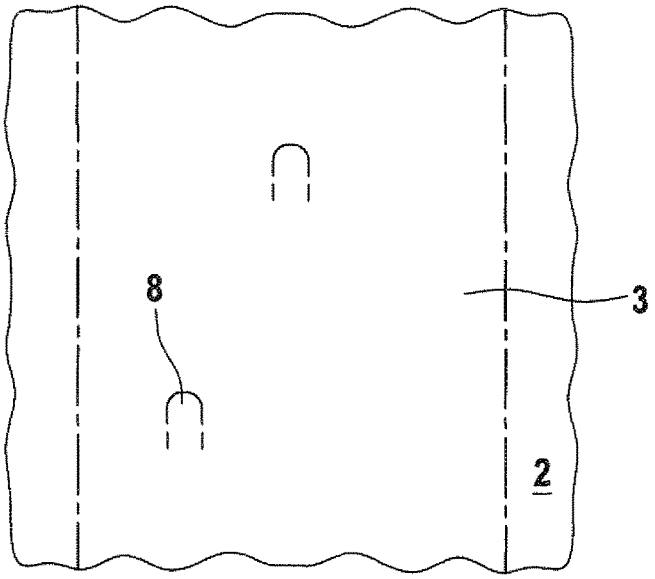
FIG. 4 shows a schematic illustration of a recess field with a second suspension device.

The pre-punched recess fields 3 do not, however, necessarily have to be removed when the advent calendar 1 is used. That can be dispensed with, for example, if the advent calendar is to be set up against a wall. In that case, it is not advantageous to hang up items/presents inside the recesses. Instead, if the advent calendar 1 is to be set up against a wall, it is more advisable to add the items/presents to the second suspension devices 8, which are pre-punched on the side parts 2. This is shown in FIG. 4, in which a side face 2 is illustrated schematically with a pre-punched second suspension device 8. That second suspension device 8 can simply be bent or folded out of the field of the side part by the user when setting up the calendar in order likewise to provide a hook or the like, on which items/presents can be hung up. When these second suspension devices 8 are used, there are no problems in using the advent calendar 1 as a wall advent calendar. In a particularly preferred embodiment, the second suspension devices 8 are arranged on the pre-punched recess fields 3. If these second suspension devices 8 are not required, they can easily be removed by removing the pre-punched recess fields 3. In an alternative embodiment, it is of course equally well conceivable to provide the second suspension devices 8 on the non-removable fields of the side parts 2.

Figure 5:
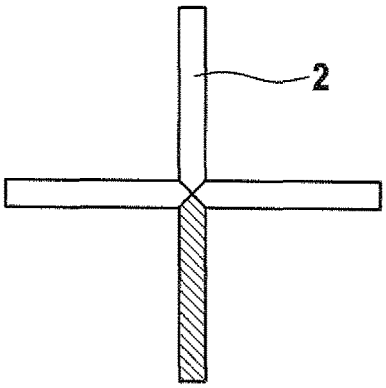
FIG. 5 shows a cross-section through an advent calendar of the invention with four side parts.
Figure 6:
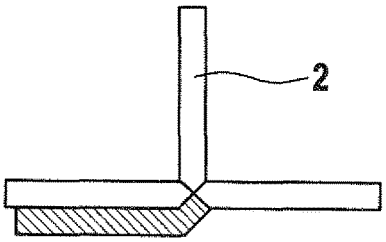
FIG. 6 shows the advent calendar in the cross-section according to FIG. 5 with a side part folded over.

The choice between use as a standing advent calendar and a wall advent calendar can be made easily by a user in that he swings or folds over at least one side part 2 of the advent calendar onto an adjacent side part 2, as is shown in cross-section in FIGS. 5 and 6.

The advent calendar 1 shown in FIG. 5 has four side parts 2, which are joined together in the region of the central axis 10. A side part 2 is configured to be folded/swung over and is shown by dashed lines in FIG. 5.

If this advent calendar 1 is to be used as a wall calendar, the side part 2 drawn with hatching can simply be folded/swung over onto an adjacent side part 2 in order to enable the advent calendar to be fixed to a wall. A person skilled in the art is aware of various possibilities for configuring the side part such that it can be folded/swung over, such as by means of a hinge. If, when it is used as a wall calendar, only one side part 2 is folded over, it goes without saying that, of four side parts originally used, one side part 2 projects into the room substantially perpendicularly from the wall. For the side part which projects into the room perpendicularly from the wall, preferably 12 suspension devices 8 are required in order to distribute the presents evenly. When, in an advent calendar 1 of the invention, two, preferably opposing, side parts 2 can be folded over onto adjacent side parts 2, an advent calendar in a substantially two-dimensional flat form is obtained.

Figure 7:
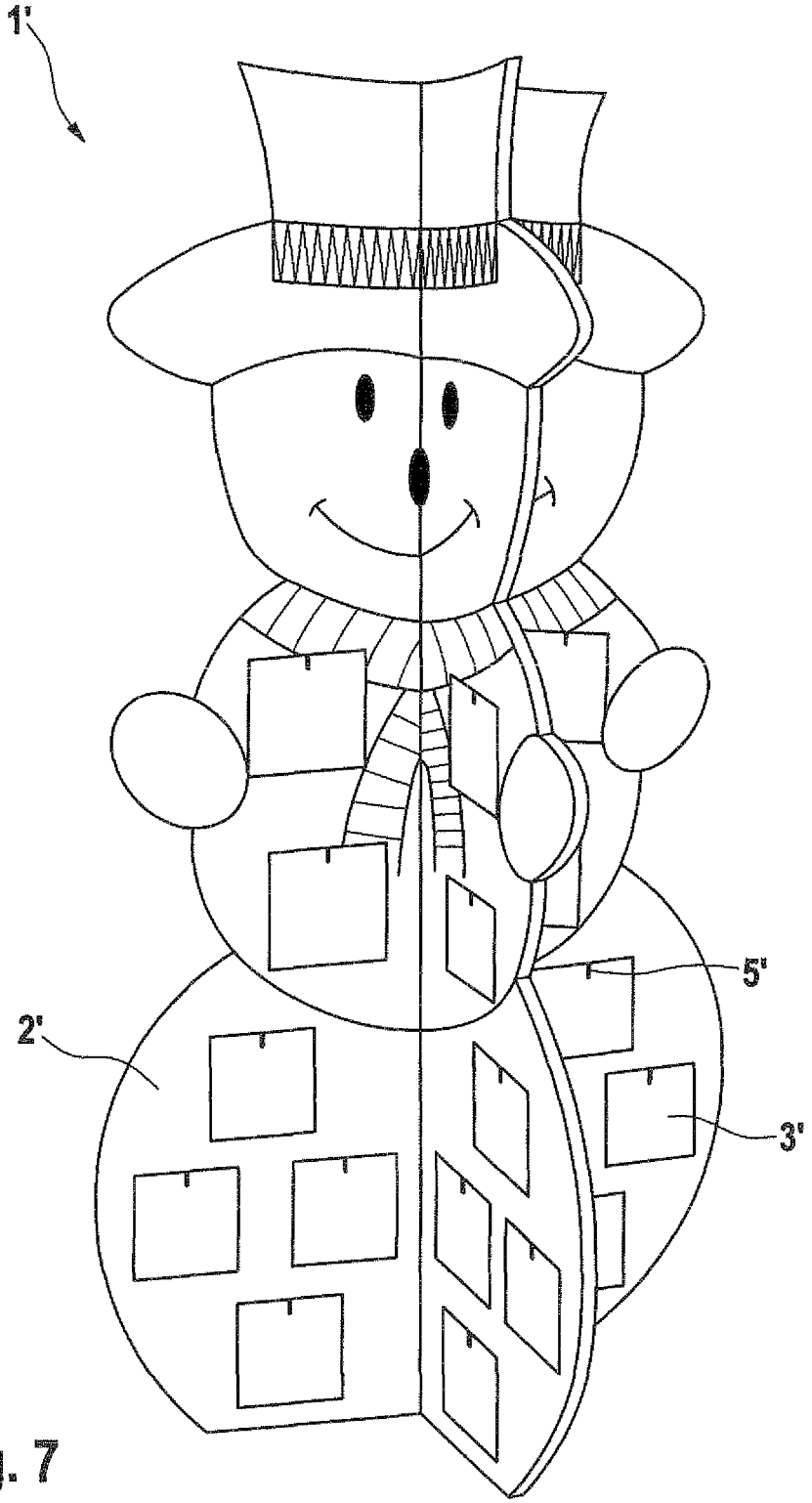
FIG. 7 shows a further schematic illustration of an embodiment of an advent calendar of the invention in the form of a snowman with side parts, recess fields and first suspension devices.

Finally, FIG. 7 shows a further embodiment 1' of an advent calendar of the invention in the form of a snowman, with side parts 2', recess fields 3' and suspension devices 5', which emphasises the flexibility of the possible blanks and shapes of the advent calendar of the invention. Other blanks and shapes are readily available, such as an advent calendar in the shape of a star, a sleigh, an angel, a Father Christmas, etc.

The features of the invention disclosed in the above description, and in the claims and in the drawing can be essential to implementing the invention both individually and in any combination.

The invention claimed is:

1. An advent calendar comprising:

at least three side parts extending substantially radially outwards from a central axis, wherein i) the side parts are joined together proximate the central axis, ii) at least one side part is at least one of removable or foldable with respect to at least one other side part, iii) the side parts define at least 24 pre-punched recess fields, iv) each pre-punched recess field is a region of one of the side parts defined by perforation in the one of the side parts, v) the side parts define a plurality of first suspension devices, each first suspension device proximate an upper portion of one of the recess fields, the first suspension devices for hanging an article in an aperture formed when a corresponding one of the recess fields is removed; and vi) a second suspension device is disposed on at least one of the pre-punched recess fields.

2. The advent calendar of claim 1, wherein the advent calendar is made of cardboard.

3. The advent calendar of claim 1, wherein the angles between adjacent side parts extending radially outwards are substantially identical.

4. The advent calendar of claim 1, wherein the at least one side part is plugged into the at least one other side part in a releasable manner proximate the central axis.

5. The advent calendar of claim 1, wherein the advent calendar has four side parts.

6. The advent calendar of claim 1, wherein at least one of the first suspension devices includes a hook.

7. The advent calendar of claim 1, wherein the advent calendar comprises a fixing means for attaching the advent calendar to a wall or ceiling in an upper region of at least one side part.

8. The advent calendar of claim 1, comprising a hinge mechanism joining the at least one side part to the at least one other side part.

9. An advent calendar comprising:

at least three side parts extending radially outwards from a central axis, wherein at least one of the side parts is at least one of removable or foldable with respect to at least one other side part, wherein the side parts define at least 24 suspension devices and at least 24 removable panels, wherein at least one of the suspension devices and at least one of the removable panels is defined by perforation in one of the side parts, wherein at least one of the suspension devices is configured to be bent out of a plane of at least one of the side parts, wherein at least one of the suspension devices is disposed outside of the removable panels, adjacent an upper portion of at least one of the removable panels, and wherein at least one of the suspension devices for hanging an article in an aperture is formed when at least one of the removable panels is removed.

10. The advent calendar of claim 9, wherein the advent calendar is made of cardboard.

11. The advent calendar of claim 9, wherein angles between adjacent side parts extending radially outwards are substantially identical.

12. The advent calendar of claim 9, wherein the at least one side part is plugged into the at least one other side part in a releasable manner proximate the central axis.

13. The advent calendar of claim 9, comprising a plurality of second suspension devices disposed on the removable panels.

14. The advent calendar of claim 9, wherein the at least three side parts include four side parts.

* * * * *